US007278493B2

(12) United States Patent
Corbett et al.

(10) Patent No.: US 7,278,493 B2
(45) Date of Patent: Oct. 9, 2007

(54) AUTO ENTRY GUIDE

(75) Inventors: Thomas G. Corbett, Willis, TX (US); Elmer R. Peterson, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 232 days.

(21) Appl. No.: 11/085,381

(22) Filed: Mar. 21, 2005

(65) Prior Publication Data

US 2006/0207769 A1 Sep. 21, 2006

(51) Int. Cl.
*E21B 33/10* (2006.01)

(52) U.S. Cl. ..... 166/387; 166/115; 166/116

(58) Field of Classification Search ..... 166/114–116, 166/117.5, 387
See application file for complete search history.

(56) References Cited

U.S. PATENT DOCUMENTS 2,114,521 A * 4/1938 Brown ..... 166/291
4,146,091 A * 3/1979 Terral ..... 166/117.5
4,286,657 A 9/1981 Kohn ..... 166/117.5
4,368,780 A 1/1983 Merritt ..... 166/117.5
4,442,893 A 4/1984 Foust ..... 166/117.5
4,951,746 A * 8/1990 Setterberg, Jr. ..... 166/114
5,303,774 A * 4/1994 Duhn et al. ..... 166/191
5,330,001 A 7/1994 Baugh et al. ..... 166/138

OTHER PUBLICATIONS

Brochure for "Model 'S-22' Multiple Acting Indicator Seal Assembly" (Oct. 1, 2003).

* cited by examiner

*Primary Examiner*—Hoang Dang
(74) *Attorney, Agent, or Firm*—Shawn Hunter

(57) ABSTRACT

Systems and methods for guiding a seal assembly associated with a string of production tubing, or a tubular member generally, into a receptacle within a wellbore. The muleshoe of a seal assembly is provided with an auto entry guide device in the form of a guide member or kickover lug that is radially moveable with respect to the muleshoe. The kickover lug is collapsible radially inwardly and biased radially outwardly. The auto entry guide device may also include a centralizer bowspring that is mounted upon the muleshoe. Additionally, the muleshoe is mounted for rotational movement with respect to the seal assembly.

17 Claims, 3 Drawing Sheets

AUTO ENTRY GUIDE

BACKGROUND OF THE INVENTION

1. Field of the Invention

The invention relates generally to methods and devices for guiding landing tubular members, such as strings of production tubing, within a receptacle within a wellbore.

2. Description of the Related Art

When sections of production tubing are run into a wellbore, they are often landed into a liner hanger or a packer to interconnect them with previously run sections of production tubing. A seal assembly is secured to the lower end of the production tubing string being run that will create a fluid seal with a receptacle in the packer or liner hanger. However, a problem associated with landing the seal assembly into the receptacle is that the entry to the receptacle is substantially-centered in the wellbore. If the wellbore is deviated, the seal assembly will tend to engage the edge of the receptacle instead of entering it. In order to correct the problem, it is often necessary to axially reciprocate and/or to rotate the production string in order to achieve proper seating. This operation is time consuming and costly and may be difficult to do if production tubing is being run from a floating rig that is prone to sea-induced motion or is equipped with control lines or cables for various completion accessories. Thus, techniques have been sought to guide the seal assembly into a proper seating within the receptacle.

Previous landing arrangements have featured a muleshoe that is secured to the lower end of the seal assembly. In this type of arrangement, a beveled kickover lug is fashioned onto the outer surface of the end of the muleshoe to help guide the tip of the muleshoe into the opening of the receptacle. This type of arrangement has been used, for example, in the Model S-22 Multiple Acting Indicator Seal Assembly available from Baker Oil Tools of Houston, Tex. This arrangement works well for the majority of landing connections to be made. However, because the lug is fixed upon the outer surface of the muleshoe, it can create an eccentricity of the muleshoe that is problematic when running into restricted inner liner diameters or combinations of restricted inner liner diameters. Additionally, the presence of a fixed lug on the outer surface of the muleshoe is not compatible with packers that rely on shifting a collect to retrieve the packer.

The present invention addresses the problems of the prior art.

SUMMARY OF THE INVENTION

The invention provides systems and methods for guiding a seal assembly associated with a string of production tubing, or a tubular member generally, into a receptacle within a wellbore. In a described embodiment, the muleshoe of the seal assembly associated with the production tubing string is provided with an auto entry guide device in the form of a guide member or kickover lug that is radially moveable with respect to the muleshoe. The kickover lug is collapsible radially inwardly and biased radially outwardly. The biasing force is significant enough to cause the lug to urge the tip of the muleshoe into the receptacle. However, when the lug is collapsed radially inwardly, the eccentricity of the muleshoe is eliminated.

In a further described embodiment, the auto entry guide device includes a centralizer bowspring that is mounted upon the muleshoe. Additionally, the muleshoe is mounted for rotational movement with respect to the seal assembly. In operation, the presence of the bowspring tends to keep the extended tip of the muleshoe oriented toward the center of the wellbore, thereby causing it to enter the receptacle. This solution is effective when the wellbore is deviated.

Generally, the entry guide devices of the present invention do not require reciprocating or rotational movement in order to guide the muleshoe and allow proper seating. Rather, they operate automatically and typically require only downward movement to cause proper seating in a receptacle.

BRIEF DESCRIPTION OF THE DRAWINGS

For a thorough understanding of the present invention, reference is made to the following detailed description of the preferred embodiments, taken in conjunction with the accompanying drawings in which like reference characters designate like or similar elements throughout the several figures of the drawing.

DETAILED DESCRIPTION OF THE PREFERRED EMBODIMENTS

Figure 1:
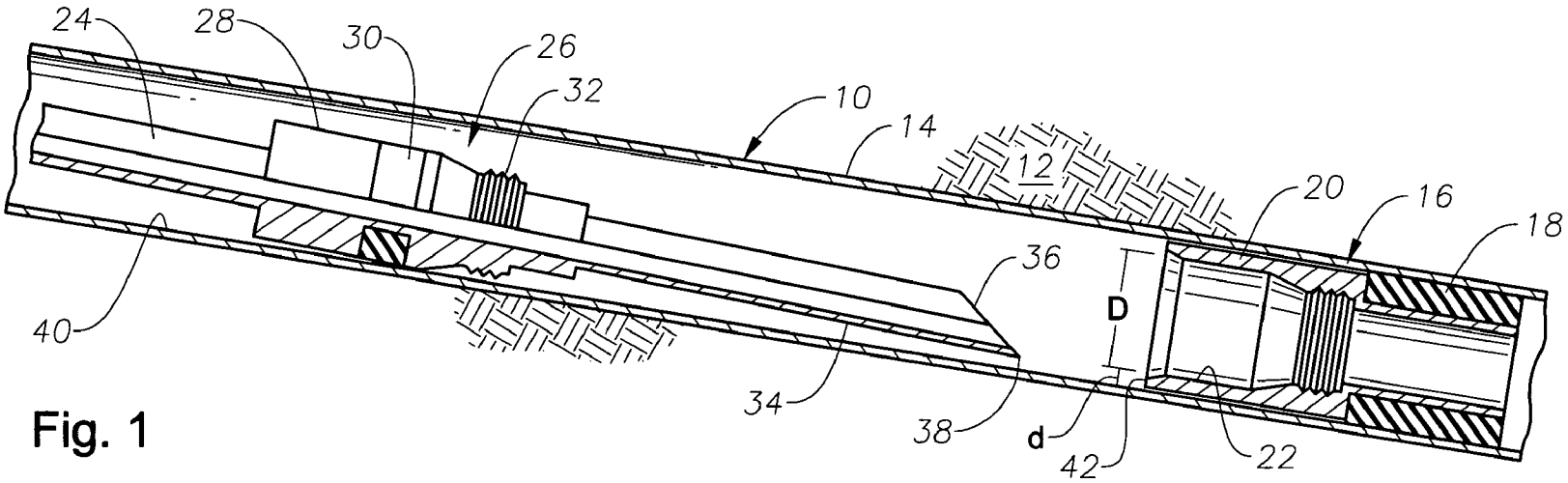
FIG. 1 is a side view, partially in cross-section, depicting an exemplary wellbore into which a string of production tubing is being run.

FIG. 1 illustrates a portion of a wellbore 10 that has been drilled generally downward through earth 12. As used herein, the terms "down," "downward," "lower," and the like refer to positions within the wellbore that are further away, as measured from the well opening. The portion of wellbore 10 is deviated and, thus, runs at an angle that approaches the horizontal. The wellbore 10 contains casing 14 and a packer assembly 16 that has been previously secured to the casing 14 in a manner known in the art. The packer assembly 16 may surround a section of production tubing (not shown) that has been previously run in and secured within the wellbore 10.

The packer assembly 16 includes a packer element, shown schematically at 18, which is set against the casing 14. The packer element 18 supports an upper body portion 20 that presents a landing receptacle 22. The landing receptacle 22 also has an interior diameter (D) that is substantially coaxially located within the wellbore 10 due to the presence of the packer element 18. The receptacle 22 is offset from the side of the wellbore 10 by a clearance distance (d).

A string of production tubing 24 is being run into the wellbore 10. A seal assembly 26 is affixed to the lower end of the production tubing 24. The seal assembly 26 has a central body 28 that carries an elastomeric seal element 30. A muleshoe 34 is secured to the lower end of the seal assembly 26. The muleshoe 34 has a slanted end face 36 that terminates in a pointed tip 38.

It is noted that the landing receptacle 22 is shaped and size to receive the seal element 30 of the seal assembly 26 when the seal assembly 26 is landed in the packer assembly 16. Although the systems and methods of the present invention are shown used with a packer assembly 16, those of skill in the art will understand that the seal assembly 26 might also be landed into a liner hanger or other device that presents a suitable landing receptacle.

It is apparent from reference to FIG. 1 that, in order for the seal assembly 26 to be landed into the landing receptacle 22 the tip 38 of the muleshoe 34 must clear the clearance distance (d) in order to enter the interior diameter (D) of the receptacle 22. This may be problematic in cases where the wellbore 10 is deviated, as FIG. 1 illustrates, because the seal assembly 26 is resting upon the lower side 40 of the casing 14. The tip 38 of the muleshoe 34 would tend to contact the upper end 42 of the upper body portion 20 rather than enter it.

Figure 2:
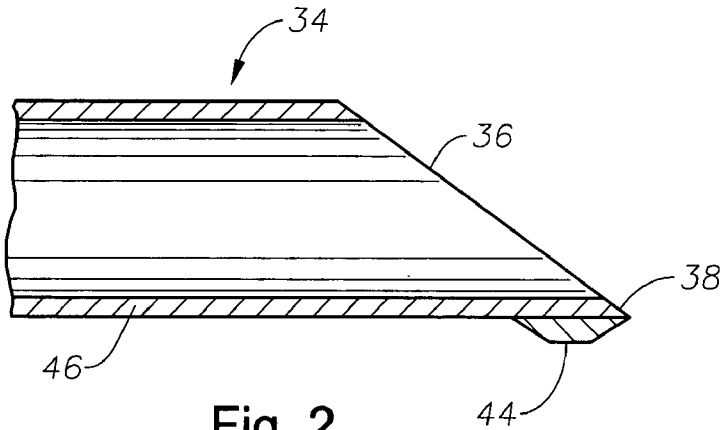
Fig. 2 (Prior Art)
FIG. 2 is a side, cross-sectional view depicting a prior art entry guide device.

FIG. 2 illustrates a prior art entry guide design for a seal assembly. The muleshoe 34 is provided with a kickover lug 44 that is fashioned on the outer radial surface proximate the tip 38. The lug 44 is integrally formed into the tubular body 46 of the muleshoe 34 and, thus, is not moveable with respect to the muleshoe 34. As noted previously, this arrangement is problematic in some instances.

Figure 3:
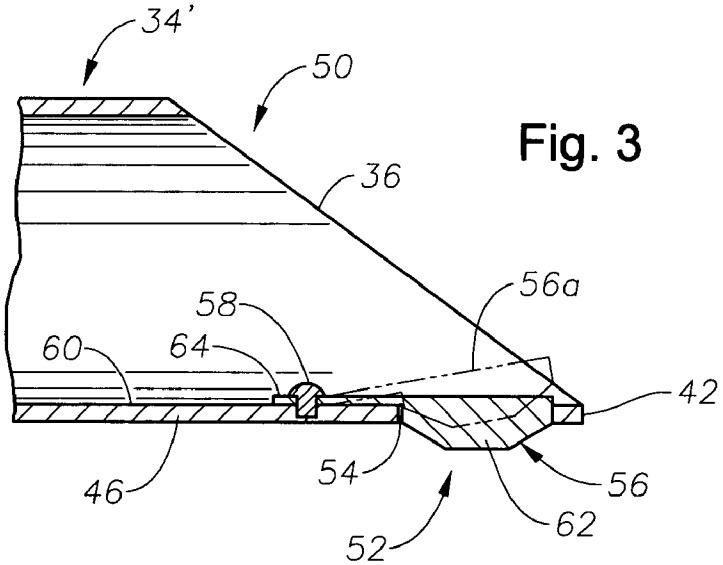
FIG. 3 is an enlarged side view of portions of a first exemplary auto entry guide tool constructed in accordance with the present invention.

FIG. 3 illustrates a first embodiment for an auto entry guide tool 50 constructed in accordance with the present invention. The guide tool 50 includes a muleshoe 34' that is provided with a collapsible kickover lug, generally indicated at 52. The muleshoe 34' has a slanted end face 36 and an extended tip 38. A window 54 is cut within the body 46 of the muleshoe proximate the tip 38. A collapsible lug member 56 is secured by connector 58 to the interior surface 60 of the muleshoe 34'. The lug member 56 has a lug portion 62 and an arm portion 64 through which the connector 58 is passed. The lug portion 62 protrudes outwardly through the window 54 and is in substantial axial alignment with the pointed tip 38. The lug portion 62 is moveable with respect to the body 46 of the muleshoe 34'. As shown in FIG. 3, the lug portion 62 is collapsible radially inwardly (see position 56*a*). The lug member 56 functions in the manner of a collect in that the lug portion 62 is spring biased radially outwardly by shape memory. However, the lug portion 62 may be biased radially inwardly by application of a sufficient force. This arrangement solves the problems of eccentricity that would exist if the lug member were fixed since the lug portion 62 may be displace inwardly when needed. At the same time, the lug portion 62 will serve to centralize the tip 38 of the muleshoe 34' so that it can enter the landing receptacle 22.

Figure 4:
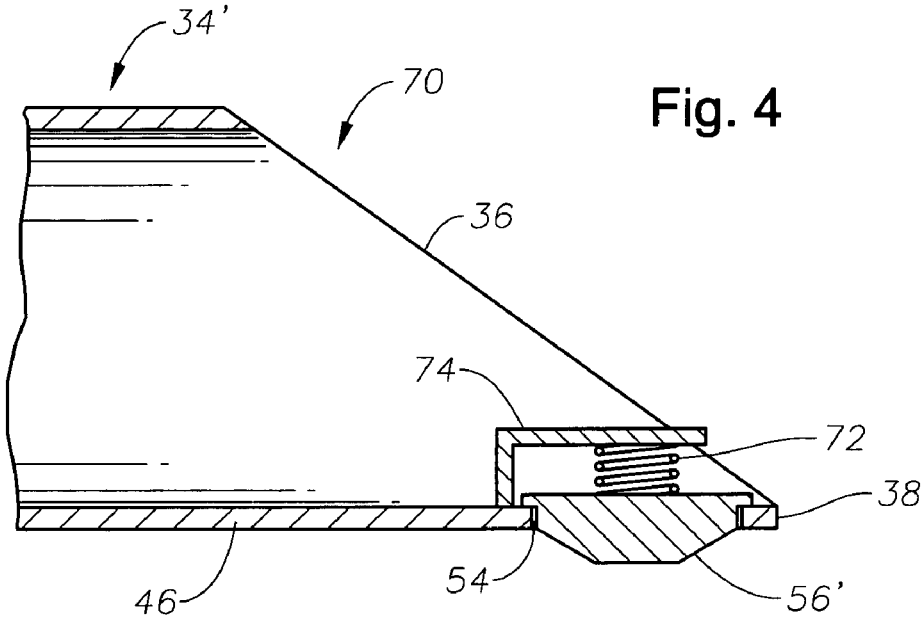
FIG. 4 is an enlarged side view of portions of an alternative auto entry guide tool constructed in accordance with the present invention.

FIG. 4 depicts an alternative auto entry guide tool 70. In this embodiment, the lug member 56' is biased radially outwardly by a compression spring 72 that resides within spring housing 74. The lug member 56' is moveable radially inwardly upon application of a suitable force. In operation, the auto guide entry tools 50 and 70 will centralize the muleshoe 34' so that its tip 38 will clear the clearance distance (d) and enter the landing receptacle 22. Reciprocation or rotation of the production tubing 24 is not necessary for proper landing. Generally, the application of downward force upon the tubing 24 is all that is necessary to cause proper landing.

Figure 6:
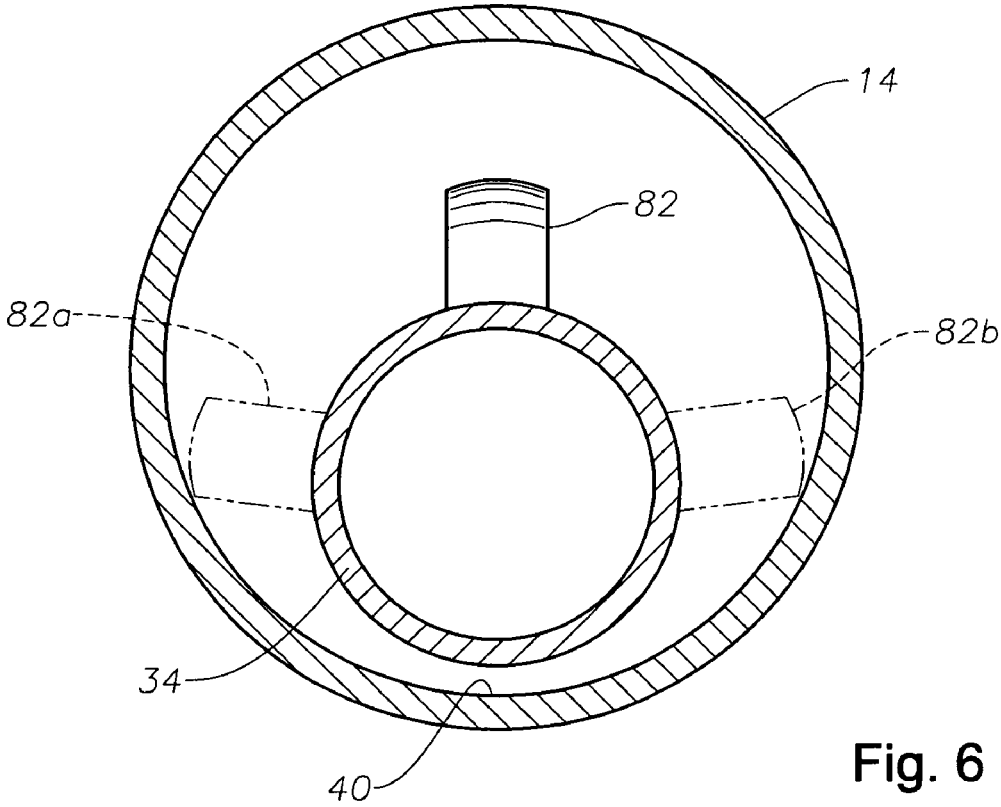
FIG. 6 is an axial cross-sectional view of the tool shown in FIG. 5.
Figure 5:
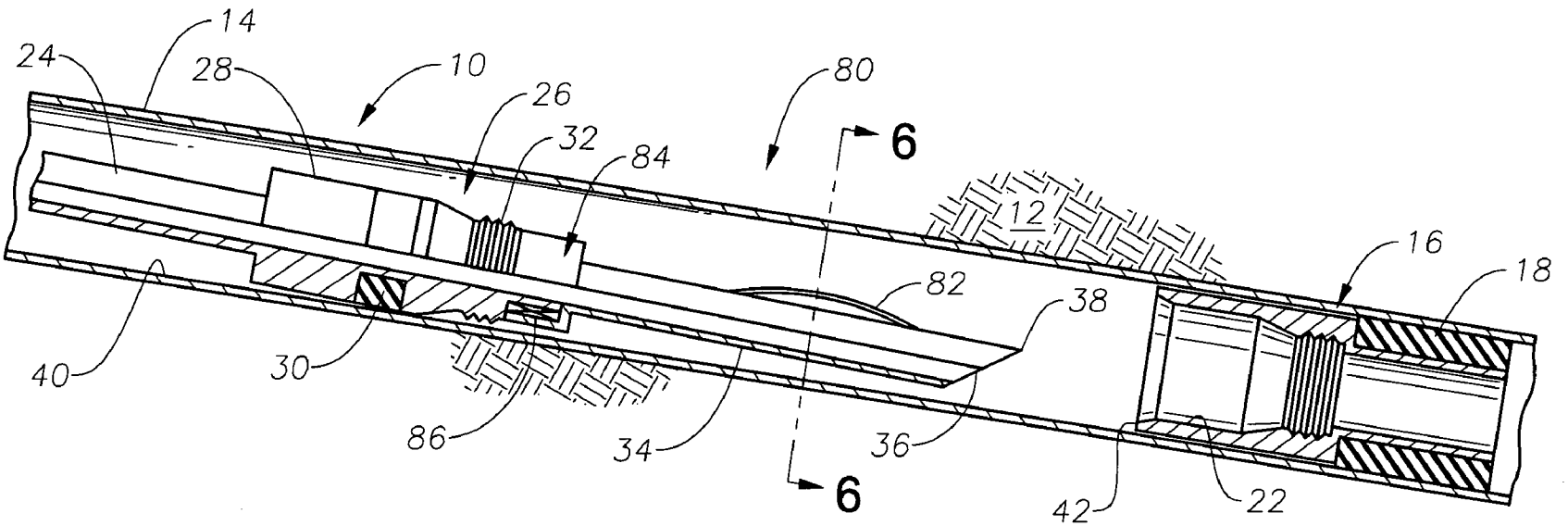
FIG. 5 is a side view of a further alternative auto entry guide tool constructed in accordance with the present invention.

FIGS. 5 and 6 depict a further alternative embodiment for a guide entry system 80 in accordance with the present invention. The guide entry system 80 is used to correct the problem of orientation of the muleshoe downhole. It is desirable to have the tip 38 of the muleshoe be proximate the center of the wellbore, thereby allowing the slanted face 36 to contact the upper end 42 of the body 20. The slanted face 36 will then guide the muleshoe 34 into the receptacle 22. A centralizer structure in the form of a bowspring rib 82 extends outwardly from the side of the muleshoe 34 in alignment with the pointed tip 38 of the muleshoe 34. Preferably, the rib 82 is a flexible bowspring that can be deflected inwardly upon application of a suitably high radial force, but is biased radially outwardly via shape-memory. It is noted that structures other than a bowspring may be used to obtain the same benefits. For example, the centralizer structure may comprise a liner bar that is secured to the outer surface of the muleshoe 34.

Additionally, the muleshoe 34 is rotationally moveable with respect to the seal assembly 26. This may be accomplished by the addition of a rotation sub 84 that rotatably connects the two components. The rotation sub 84 contains an annular bearing race of roller bearings 86 that allow for free rotational motion. During operation running the tubing string 24 into the wellbore 10, it has been observed that the muleshoe 34 tends to rotate to the position shown in FIGS. 5 and 6 with the rib 82 and tip 38 oriented toward the center of the wellbore 10. Additionally, rotational movement of the muleshoe 34 in either direction will tend to be limited by the rib 82, which will contact the casing, as shown in positions 82*a* and 82*b* in FIG. 6. In this manner, the centralizer rib 82 acts as a guide member for the muleshoe 34. In the unlikely event that the muleshoe 34 became oriented such that the rib 82 were in contact with the lower side 40 of the casing 14, the centralizer rib 82 would still deflect the tip 38 radially inwardly so that it could enter the receptacle 22.

Those of skill in the art will recognize that numerous modifications and changes may be made to the exemplary designs and embodiments described herein and that the invention is limited only by the claims that follow and any equivalents thereof.

What is claimed is:

1. A guide system for positioning a seal assembly being run within a wellbore to a cooperating landing receptacle, the guide system comprising:

a seal assembly carried on a tubing string;

a muleshoe secured to the seal assembly and having a tubular body and a slanted end face having a pointed tip; and a guide member associated with the tubular body in general axial alignment with the pointed tip, the guide member being radially inwardly collapsible with respect to the tubular body.

2. The guide system of claim 1 further comprising:

a lateral window in the body of the muleshoe; and the guide member comprises a lug portion that is biased radially outwardly through the window.

3. The guide system of claim 2 wherein the lug portion is biased radially outwardly by shape memory.

4. The guide system of claim 2 wherein the lug portion is biased radially outwardly by a spring member.

5. The guide system of claim 1 wherein the guide member comprises a centralizer rib.

6. The guide system of claim 1 further comprising a rotatable connection between the muleshoe and the seal assembly to allow rotational movement of the muleshoe with respect to the seal assembly.

7. A landing assembly for production tubing that is substantially self-guiding into a landing receptacle within a wellbore comprising:

a seal assembly to be secured to a section of production tubing, the seal assembly having a body for seating within a complimentary landing receptacle;

a muleshoe affixed to the seal assembly, the muleshoe having a tubular body and a slanted end face with a pointed tip; and a guide member mounted on the body of the muleshoe, the guide member being radially inwardly collapsible.

8. The landing assembly of claim 7 wherein the guide member is mounted on the body of the muleshoe in substantial axial alignment with the pointed tip.

9. The landing assembly of claim 7 wherein the guide member has a lug portion is biased radially outwardly by a spring member.

10. The landing assembly of claim 7 wherein the guide member has an arm portion that is secured to the muleshoe body and a lug portion that projects radially outwardly, the lug portion being collapsible radially inwardly in the manner of a collect.

11. A guide system for a centralizing a seal assembly being run within a wellbore to a cooperating landing receptacle, the guide system comprising:

a muleshoe having a tubular body and a slanted end face having a pointed tip;

a centralizing structure secured upon an outer surface of the tubular body in general axial alignment with the pointed tip; and a rotational connection for securing the muleshoe to a seal assembly such that the muleshoe is able to rotate with respect to the seal assembly.

12. The guide system of claim 11 wherein the centralizing structure comprises a bowspring.

13. The guide system of claim 11 wherein the rotational connection is provided by a rotational sub having an annular bearing race of roller bearings.

14. A method of guiding a seal assembly associated with a production tubing string to a landing with a landing receptacle within a wellbore having an axial center, the method comprising the steps of:

securing a muleshoe to the seal assembly, the muleshoe having a tubular body, a slanted end face having a pointed tip, and a radially collapsible guide structure secured upon an outer surface of the tubular body in general axial alignment with the pointed tip;

running the tubing string, seal assembly and muleshoe into a wellbore; and allowing the guide structure to centralize the pointed tip into the landing receptacle.

15. The method of claim 14 wherein the guide structure centralizes the pointed tip by urging it radially inwardly within the wellbore beyond a clearance distance.

16. The method of claim 14 wherein the step of securing the muleshoe to the seal assembly further comprises affixing the muleshoe by a connection that allows the muleshoe to rotate with respect to the seal assembly.

17. The method of claim 16 wherein the guide structure centralizes the tip by helping to ensure that the muleshoe is oriented such that the pointed tip is proximate the axial center of the wellbore.

* * * * *

UNITED STATES PATENT AND TRADEMARK OFFICE

CERTIFICATE OF CORRECTION

PATENT NO. : 7,278,493 B2
APPLICATION NO. : 11/085381
DATED : October 9, 2007
INVENTOR(S) : Corbett et al.

It is certified that error appears in the above-identified patent and that said Letters Patent is hereby corrected as shown below:

Column 5, line 16, the word “collect” should read -- collet --.

Signed and Sealed this

Eighteenth Day of December, 2007

JON W. DUDAS
*Director of the United States Patent and Trademark Office*